US008702542B2

(12) United States Patent
Parenti

(10) Patent No.: US 8,702,542 B2
(45) Date of Patent: Apr. 22, 2014

(54) TOTAL CONTROL BATTING BALL

(76) Inventor: Pete Parenti, Forest Park, IL (US)

( * ) Notice: Subject to any disclaimer, the term of this patent is extended or adjusted under 35 U.S.C. 154(b) by 350 days.

(21) Appl. No.: 12/963,562

(22) Filed: Dec. 8, 2010

(65) Prior Publication Data

US 2011/0312433 A1 Dec. 22, 2011

Related U.S. Application Data

(60) Provisional application No. 61/267,784, filed on Dec. 8, 2009.

(51) Int. Cl.
*A63B 41/04* (2006.01)

(52) U.S. Cl.
USPC ..... 473/594; 473/595; 473/610; 473/611

(58) Field of Classification Search
USPC ..... 473/594, 595, 577, 598, 610, 611
See application file for complete search history.

(56) References Cited

U.S. PATENT DOCUMENTS

| | | | | | |
|---|---|---|---|---|---|
| 1,754,937 | A * | 4/1930 | Comstock | 5/636 |
| 1,990,374 | A * | 2/1935 | Goldsmith | 137/223 |
| 1,991,671 | A * | 2/1935 | Hodson | 473/594 |
| 2,134,634 | A * | 10/1938 | Goldsmith | 473/611 |
| 2,219,074 | A * | 10/1940 | Le Guillou | 473/594 |
| 2,760,775 | A * | 8/1956 | Tipton | 473/610 |
| 3,480,280 | A * | 11/1969 | Gamertsfelder | 473/594 |
| 3,734,498 | A * | 5/1973 | Seiersen | 473/594 |
| 4,240,630 | A * | 12/1980 | Hoffman | 473/610 |
| 4,274,633 | A * | 6/1981 | Benscher | 473/610 |
| 4,354,679 | A * | 10/1982 | Steinmetz | 473/594 |
| 4,448,418 | A * | 5/1984 | McNeill | 473/594 |
| 4,513,058 | A * | 4/1985 | Martin | 428/336 |
| 4,872,676 | A * | 10/1989 | Townsend | 473/594 |
| 4,963,117 | A * | 10/1990 | Gualdoni | 446/219 |
| 5,070,610 | A * | 12/1991 | Leslie | 473/594 |
| 5,098,329 | A * | 3/1992 | Tseng | 446/221 |
| 5,158,284 | A * | 10/1992 | Vogl | 473/594 |
| 5,480,155 | A * | 1/1996 | Molitor et al. | 473/354 |
| 5,516,098 | A * | 5/1996 | Aiello | 473/594 |
| 5,577,732 | A * | 11/1996 | Spector | 473/576 |
| 5,611,541 | A * | 3/1997 | Paino | 473/594 |
| 5,722,906 | A * | 3/1998 | Gentile | 473/594 |
| 5,749,799 | A * | 5/1998 | Jasperson | 473/594 |
| 5,772,543 | A * | 6/1998 | Paino | 473/594 |
| 5,779,968 | A * | 7/1998 | Richwine et al. | 473/610 |
| 5,891,000 | A * | 4/1999 | Phillips | 473/594 |
| 5,924,942 | A * | 7/1999 | Gentile | 473/570 |
| 6,322,465 | B1 * | 11/2001 | Gentile | 473/594 |
| 6,645,098 | B1 * | 11/2003 | Quinn | 473/594 |
| 6,949,276 | B2 * | 9/2005 | Jain et al. | 473/610 |
| 2005/0143204 | A1 * | 6/2005 | Lin | 473/594 |
| 2005/0239584 | A1 * | 10/2005 | Willyerd | 473/600 |
| 2010/0261561 | A1 * | 10/2010 | Wang | 473/594 |
| 2010/0285910 | A1 * | 11/2010 | Spector | 473/596 |
| 2011/0165978 | A1 * | 7/2011 | Leefeldt | 473/594 |

* cited by examiner

*Primary Examiner* — Steven Wong
(74) *Attorney, Agent, or Firm* — Tracy M. Heims; Apex Juris, pllc

(57) ABSTRACT

The invention is for a weighted ball designed to be hit or struck where the ball has a resilient, flexible, nonburstable outer shell, a hollow inner chamber and a filler hole where a weighted filler material is inserted into the hollow inner chamber through the filler hole and where the air inside the hollow inner chamber that displaces the remaining space inside the hollow inner chamber and where the inside air pressure is equal to the outside air pressure, and where a hole plug seals the filler hole after filling the hollow inner chamber with the weighted filler material, and where a hole plug sealant is used to fill the vacant hole plug space and to reinforce and strengthen the hole plug.

16 Claims, 9 Drawing Sheets

TOTAL CONTROL BATTING BALL

FIELD OF THE INVENTION

The present invention relates to a specially weighted ball used to train hitters or hitters for softball, baseball, cricket, over-the-line ball, t-ball, golf or any other ball sport that involves striking a ball with a bat, club or any other hitting object.

BACKGROUND OF THE INVENTION

Softball and baseball hitters develop their skills by participating in batting practice. There are several major obstacles and problems associated with using a regulation ball for batting practice. One major problem with using a regulation ball for batting practice is that the ball typically travels great distances when hit by hitters. This means that, to avoid property damage or personal injury to other players in the near vicinity, large spaces are required for batting practice, such as an outside practice area. Alternatively, the use of safety nets, screens or specially designed batting cages can be implemented; however, it is more costly, time consuming and difficult to set up all the nets or screens in addition to the fact that there is still the possibility that the ball will get past the nets or screens. A weighted ball that is energy absorbing, nonburstable and soft, so as to travel shorter distances when hit, is highly beneficial.

Also, it is known that dynamic training with weighted objects enhances strength, speed and conditioning. In addition, the hitter or the instructor wishes to know immediately whether or not the hitter hit the ball properly, that is, on the center line or off-center of the ball. Furthermore, it is desirable to control the size of the practice ball so as to develop hand/eye coordination. There is an unfulfilled need in the market for a ball that meets all of the above requirements.

One art of which applicant is aware is the Muhl Ball™. Although the Muhl Ball™ is designed for batting, it is different from the present invention in that it weighs one pound, has a foam core and is 20 inches in circumference. The Muhl Ball™ has several disadvantages. First, the Muhl Ball™ is too big to toss underhanded (as required by softball rules) or overhand and because of this size problem the ball is typically placed on a t-stand for practice purposes. Thus, it does not allow for an effective simulation of regulation game play. Next, because the ball is filled with a spongy type material it absorbs some bat impact but does not deform to instantly show the hitter if she hit the ball properly or not. Because of this configuration and composition the ball travels very far. Additionally, the Muhl Ball™ is expensive.

Another related art is seen in the Power Systems™ training balls. These balls come in three different weights, 7 ounce, 14 ounce and 21 ounce and even though they have differing weights they are all dimensionally at least 9 inches in diameter. These balls are designed specifically for pitching training and specifically to strengthen and rehabilitate the shoulder. They help to develop dynamic strength through the throwing motion. They are made of a thin vinyl shell and are filled with some sort of material. These are not designed to be used for batting practice as the ball structure simply will not withstand the continual strikes from a bat. This is due in large part to their construction, that is, they are made from a thin outer shell and they have a weak valve structure. A simple plug is inserted into the filler valve of these balls. This plug is sufficient for throwing, however, when struck with a bat the valve becomes a weak spot and is susceptible to damage or breakage making the ball useless.

Basketballs, deflated basketballs or volleyballs and 16 inch softballs are also used as practice balls but again, they all have limitations that are similar to the above referenced limitations that do not make the balls practical or desirable options for batting practice. These options do not offer all of the benefits of the present invention.

There is also a withdrawn Japanese patent application for a weighted golf ball that is filled with a granular material. The shell is made of a resilient material and the ball can be filled with sand, metal particles, water, or any other filler that will add weight to the ball. This application does not teach or give any indication of how the ball is filled or how the material stays inside the ball. It simply teaches a weighted golf ball.

SUMMARY OF THE INVENTION

The present invention is a durable and environmentally friendly batting practice ball that can be used without a safety net and is designed to be tossed directly from in front of the hitter or from the side of the hitter. The ball is designed to develop strength, a proper swing with extension through the hitting zone, and to allow the hitter to perform full hitting with the ability to instantly see if proper contact has been made between the bat and the ball, all within a limited space. Because of the unique design, the ball will retain its spherical shape before hitting and after hitting if the ball is hit properly, that is, at the center line of the ball. If hit other than at the center line, for example, above or below the center line, the ball spin generated by the off center contact of the bat against the ball and the resultant centrifugal forces will cause the ball to donut perpendicular to the horizon (flatten out and look like a donut due to the filler material). Additionally, the ball reacts differently when struck with an inside out or open swing. This swing is the type where the hitter's hands travel through the hitting zone ahead of the barrel of the bat and the ball is driven to the opposing direction or field. In this scenario, the ball will donut horizontal to the ground, thus again letting the hitter know that she has hit the ball incorrectly.

In any situation where the ball is hit incorrectly, the ball will remain in the donut shape until the centrifugal force acting on the ball is reduced enough to allow the filler to come to rest in its natural form; or the ball comes to a stop. Because of this ball mutation, it is easy for the hitter and/or the instructor to know immediately if proper contact is or is not made during each hit. If proper contact is not made then the instructor (or hitter) will know immediately what the hitter is doing wrong, that is, hitting too high, too low, inside, outside, etc. and will be able to provide instantaneous feedback based on the immediately known information. Additionally, based on the amount of spin and the resultant donuting it is also possible to ascertain just how badly the ball has been hit and thus provides the trainer with continued information on whether or not the hitter is actually improving her swing.

The ball's exterior or skin is constructed from a special blend of materials that are nonburstable. The ball is filled with natural materials, synthetic materials, or a mixture of synthetic and natural materials. Preferably this mixture has a 1.3 to 2.2 weight to volume ration difference. The compound of the filler material may have differing granular configurations and screen mesh sizes that will allow the proper weight and ball reactions. The ball can be made in multiple sizes and may be used for a variety of sports, including softball, baseball, cricket, stickball, over-the-line ball, t-ball, golf or any other ball sport that involves striking a ball with a bat, club or any other hitting/batting object.

In general, the ball of the present invention has numerous advantages over prior balls, including but not limited to developing dynamic strength, giving instant feedback to the hitter, it has no seams, it has a floating filler or core of ball, it develops eye-hand coordination, it requires drive and extension thru the hitting zone to hit the ball correctly, it is water, weather and temperature resistant, it is soft enough to catch with the bare hand and it is designed to collapse around a bat and absorb energy from the bat. Because the ball filler is composed of different sized particles the particles absorb substantially more energy than a solid ball or a singled sized filler ball and the variously sized material allows the smaller particles to move into the spaces between the larger particles allowing greater compressibility and thus a less jarring effect on the hitter.

The ball is not designed to be thrown overhand as it is developed specifically for hitting but is not designed to be used in a pitching machine. Finally, the ball is longer lasting because there is no seam. The ball may also be designed such that it does not have a plug, which also makes it easier to use.

BRIEF DESCRIPTION OF THE DRAWINGS

The above and other objects of the present invention will become readily apparent by reference to the following detailed description when considered in conjunction with the accompanying drawing wherein.

DETAILED DESCRIPTION OF THE INVENTION

Figure 1:
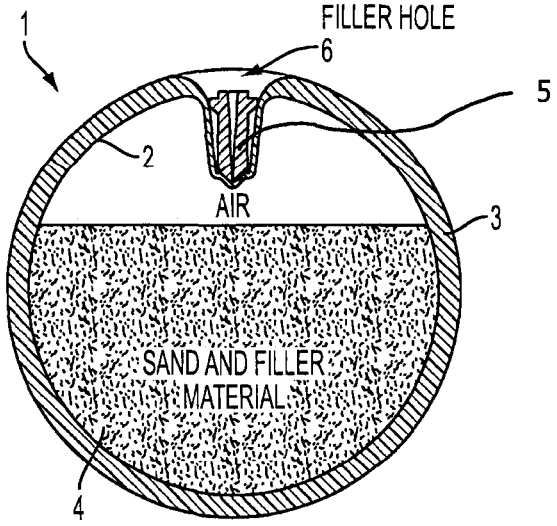
FIG. 1 is a sectional view of the batting practice ball.
Figure 2:
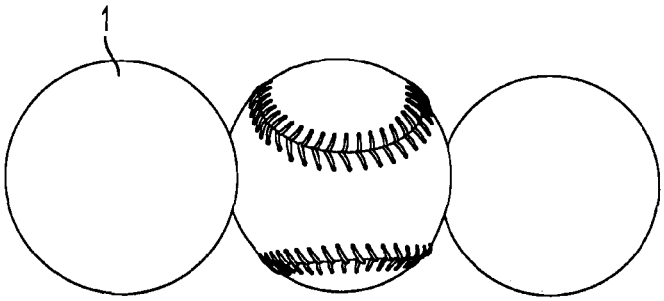
FIG. 2 is an elevated view of the ball showing the resemblance to a regular softball; also showing the present invention baseball.
Figure 3:
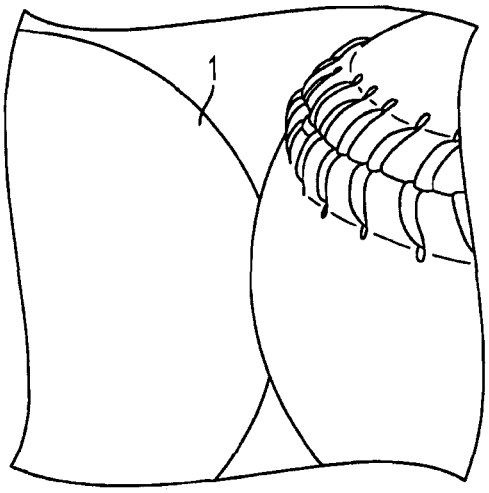
FIG. 3 is an outside cover comparison of a standard softball and the present invention.
Figure 4:
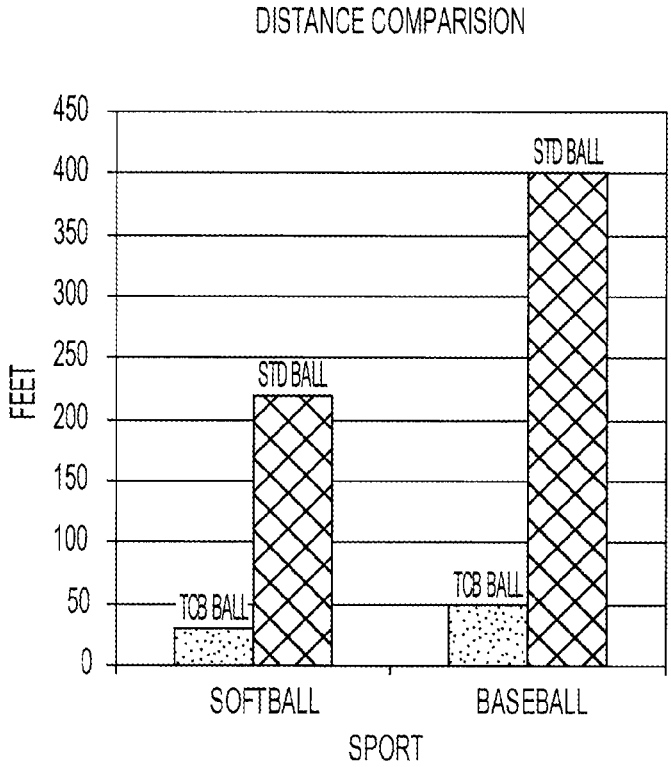
FIG. 4 is a graphical representation of distances traveled by a regular softball versus the ball of the present application.

Currently there exist numerous types of practice batting balls and hitting balls for the sports listed above. However, none of these balls are structurally the same, are used the same or provide all the advantages of the present invention. One embodiment for the present invention is a weighted softball designed to change shape when hit improperly. The following description and explanation relates mainly to softballs but it should be noted that it can apply to any other ball as well, such as golf balls, baseballs, cricket balls, and any other balls used in a batting sport or hitting sport.

When playing baseball or softball it is extremely important to practice batting, or hitting, and through practice it is important to learn the proper way to hit a ball 1. In baseball and softball the hitter 9 strives to obtain a level swing. In other words, the hitter wants to bring the bat 10 around and swing level through the hitting zone and then extend through the ball 1 and ultimately finish with her hands high. This is often difficult to teach because it is not always obvious to the hitter 9 or trainer when she has hit the ball 1 incorrectly.

Batting practice is designed to develop hitter mechanics. However, by using the ball of the present invention batting practice also will build hitters strength. During a game a hitter may only hit several times. However, during batting practice the hitter may hit numerous times. This practice is designed to build muscle memory and thus improve the player's batting strength.

Level Swing.

Presently, there are several methods used to both teach hitters how to hit properly and to develop muscle memory. As noted, a level swing is extremely important. One method of training a hitter to develop a level swing is to use a T-stand. A T-stand is simply a batting stand and the ball 1 is placed on top of the stand, that is approximately waist height in relation to the hitter, but is typically also adjustable. Obviously this does not sufficiently replicate real life pitching and hitting and as such has limitations.

One training method currently available that uses the T-stand is The Muhl™ ball. This ball is designed to provide batting training. The Muhl™ ball weighs one pound, has a foam core and is 20 inches in circumference. Due to its large diameter and weight, it is not designed to be pitched and thus is typically used on a T stand, as was explained above. This is a good training method to develop a level swing but it does not replicate real pitching. Because of its weight the Muhl™ Ball typically cannot be pitched and thus must be used only on a T-stand. Also, because of its large diameter, it does not adequately replicate hitting a real softball. Finally, because the ball has a solid, foam core it does not change shape when it is hit so the hitter cannot really know if she is hitting the ball on the center or not.

Strength Training.

A level swing is important but so is strength training. The Muhl™ ball is a heavy ball and thus can provide strength training. However, the ball diameter is so large that it does not adequately represent hitting a regulation size ball. It is also quite solid and resilient so the balls fly further and not much energy is actually absorbed by the ball.

Another commonly used method to develop strength is to hit deflated basketballs or volleyballs. These were commonly used because they stop the bat motion when struck and the hitter must muscle through the ball. However, when struck they cause a jarring effect and can possibly injure the hitter because they quickly reach a compression point where the air inside can be compressed no more. This is potentially dangerous for hitters and not truly beneficial for developing strength. Also, they are difficult to pitch and they do not provide the real life feel of hitting a baseball or softball, mostly due to the size and to their deformed shape. Also, when struck they travel in a peculiar or strange flight pattern due to their deformed shape, making them difficult to retrieve and to use for long periods of time.

Another method used for strength training is to strike a stationary weighted bag of some sort. This supposedly develops hand, wrist and forearm strength at contact. Again, this bag again does not replicate actual hitting as the bag is stationary and when it is hit it is pushed forward and then it swings back into place. It also can be somewhat dangerous and could cause injury to the hitter.

Muscle Memory.

As can be understood from above, it is extremely desirable to have a weighted ball. Using a heavier ball requires the hitter to use more energy when hitting the ball and as a result helps to greatly improve the hitter's batting strength. Additionally, this same weighted ball and motion creates increased muscle memory. Because the ball is generally the same size as a regulation ball the hitter swings as if hitting a regulation ball, thus practicing proper form. The hitter's swing goes through the hitting zone. The hitting zone is the horizontal plane of the ball, from just before and until just after the ball passes the back edge of home plate. The hitter begins her swing, makes contact and follows through the hitting zone of the ball as if hitting a regular ball but because of the design and weight the ball does not travel as far. However, hitting the ball of the present invention requires greater bodily muscle use. Hitting this weighted ball causes the hitter to gain muscle strength and dramatically increases her hitting ability. Because the same muscles are used to hit a regular ball the hitter additionally builds muscle memory. Due to the increased muscle memory regular balls are struck with more force and thus have improved exit speeds when hit.

When an active person repeatedly trains movement, that is, muscle activity of the same muscle through the same activity, in an effort to stimulate the mind's adaptation process, the outcome is to induce physiological changes which attain increased levels of accuracy through repetition. Even though the process is really brain-muscle memory or motor memory, the colloquial expression "muscle memory" is commonly used. Individuals rely upon the mind's ability to assimilate a given activity and adapt to the training. As the brain and muscle adapts to training, the subsequent changes are a form or representation of its muscle memory. In other words, the hitter is able to build up the muscles used in hitting using the weighted ball and then when batting with a regular sized and weighted ball the muscles remember the action and thus transfer the muscle strength into batting the un-weighted ball, thus providing the hitter with increased batting strength. As is known, repetitive muscle use increases muscle mass, strength and memory.

To explain further, there are two broad types of voluntary muscle fibers: slow twitch and fast twitch. Slow twitch fibers contract for long periods of time but with little force while fast twitch fibers contract quickly and powerfully but fatigue very rapidly. For example, when a runner is running the fast twitch muscles are used in pulling up and putting down the runner's foot. The slow twitch muscles are used to pull the ground underneath the runner as she runs. When hitting, the fast twitch muscles are used in bringing the bat around from the raised position to the ball contact position, and slow twitch muscles are used to push through the ball. In other words, the raw strength part of the swing. Using the ball of the present invention develops both fast twitch muscle fiber and slow twitch muscle fiber.

Thus, it is extremely desirable to have a ball 1 that is substantially the same size as a regulation ball of any sport but weighs more. Obviously, if the ball is the same size or smaller than a regulation ball the hitter will see the ball as the same size and will not be trained to hit a larger ball or a bag. This is advantageous due to the fact that during games the player will be playing with a regulation size and weight ball. It is also important to have a ball that is similar in size or smaller than a regulation ball that can be pitched from in front of the hitter or tossed to the hitter from directly in front of the hitter or from the side. Additionally it is desirable to have a safe, nonburstable, economical ball. The ball of the present invention provides all of these advantages.

Flexible Ball and Deformable.

The present invention uses a flexible, pliable PVC, preferably non-phthalate material, as the external skin, or outer shell 3. Its non-breakability is important for many reasons. First, this material is strong enough to withstand multiple batting strikes thus giving the ball longevity. This longevity is important because the balls are somewhat expensive to manufacture and of course these costs ultimately pass through to the consumer. Having a ball that does not break benefits the consumer because she does not have to continually purchase replacement balls.

Next, the flexibility and durability allows for utilizing a variety of ball filler materials 4. Although the present invention utilizes specific materials it should be noted that a variety of different fillers could be used. Additionally, this flexibility and non-burstability of the ball outer shell 3 allows greater weight to be added to the ball, depending on the material filler 4.

Safety.

Additionally, this flexibility makes the ball much safer than other practice balls. This occurs for a number of reasons. First, the flexibility allows the weighted filler to disburse across a greater area than the area of a ball at rest, greatly decreasing the per square inch pressure when hit, thus removing any incurring damage or breakage to the bat or the object used to hit the ball. Also, due to the energy absorption the ball does not travel as far or as fast as a standard ball when hit, making it safer and easier to catch.

Visual Feedback.

Most important however, is the fact that the flexibility and deformability of the ball provides the hitter with instant, visual feedback. The ball reacts differently when it is struck properly as to when it is struck improperly. This is more fully described below.

Composition.

The practice batting ball of an embodiment of the present invention is generally the same size or smaller than a regulation size softball. However, the structure, design and components are entirely different. FIG. 1 shows a ball of the present invention properly filled to the proper percentages. Ideally, the ball face accounts for approximately 20% of the weight. In one embodiment the ball is filled with either natural materials, synthetic materials, or a mixture of synthetic and natural materials. Preferably this mixture has a 1.3 to 2.2 weight to volume ration difference. The compound of the filler material may have differing granular configurations and screen mesh sizes that will allow the proper weight and ball reactions.

In a second embodiment the ball is filled with a ferrous material and sand, preferable proportions of filler material are approximately 50% ferrous material and 30% sand. Preferably, the sand is river sand rather than regular sand as river sand is smoother and does not have sharp edges that are present in regular sand. This prevents the skin from ripping because of the sand impregnating itself into the skin. Note that these amounts are not exact numbers and may vary.

The practice ball of the present invention has an outer, spherical, flexible external shell 3 designed to withstand contact from bats 10 over numerous strikes without bursting. This shell is then filled through hole 6 with a combination of multiple sized fillers 4, such as a synthetic material, sand, iron particles and or other small particles so that when a hitter 9 hits the ball 1 the energy from the hitter's swing propagates throughout the ball 1 and the filler 4 so the hitter's energy is maximally absorbed. A small percentage of ultra fine powder may also be added to fill micro-voids and help cushion and lubricate the inner shell surface 2 of the ball.

In an embodiment for a softball, the practice ball is an approximately 5 to 13.5 cm in outer diameter. The hollow ball shell is made of pliable, flexible, durable environmentally safe PVC, non-phthalate material with at least a 3 mm wall thickness. This outer shell is molded, or blow formed into a ball shape, creating a hollow inner cavity. After molding the shell is then filled through an aperture, valve or filler hole 6 with a mixture of special compounds, where the special compound can be either a synthetic material, silica sand, river sand or other natural sands, iron or iron based materials. The filler compound could also be a mixture of any of the above, as long as the appropriate weight is reached. These filler materials 4 are injected into the ball 1 through the filler hole 6. Additionally, a small percentage of an ultra fine powder, typically less than 1%, may be inserted and combined with the other materials. The ultra fine powder is used to help fill voids between the different sized sand, synthetic material and/or ferrous particles in order to help provide a lubricating effect between the sands and the inner shell 2 PVC, non-phthalate material, thus providing a longer life span for the shell material.

After the ball is filled with the weighted material through the filler hole a self-sealing plug 5 is inserted into the filler hole. This self sealing plug 5 also acts as a valve such that when an air needle is inserted into the ball through the plug to add or remove air, when the needle is removed the plug self-seals, thus keeping the air in the ball. In the present invention, any additional air is removed after filling through the self-sealing plug 5, like a basketball air filler, such that the outside air pressure and the internal air pressure are equal. Ambient or slightly negative pressure levels of air are slight and allow the shell strength to return the ball to its spherical size without deforming the ball when at rest.

Filler Hole and Plug Sealant Description

The filler hole 6 of the present invention as shown in FIG. 9 can be a standard type valve used in typical basketballs, volleyballs, or any other ball that must be filled with material or air. However, it is preferred that the valve be of a type that is completely sealed within the ball after filling, as shown in FIG. 9F. The problem with the standard valve, as shown in FIG. 9, is that it is generally used on balls that are bounced or rolled, but not struck. When they are used on a ball that is continually struck they cause a weak spot in the ball. For example, if the hitter strikes the valve stem directly it is forced into the center of the ball. This also occurs when the ball is struck directly on the opposite side. Either event causes the valve stem to become weak and eventually it will leak and may even be forced out of the ball, causing the filler release prematurely. It is preferred to have a valve that is protected. For example, it is possible to add protection to the valve stem.

Figure 10A:
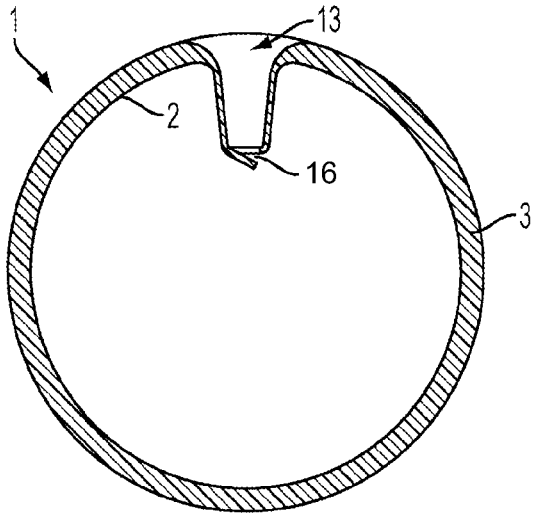
FIG. 10A is a sectional view showing another embodiment with a stem flap.
Figure 10B:
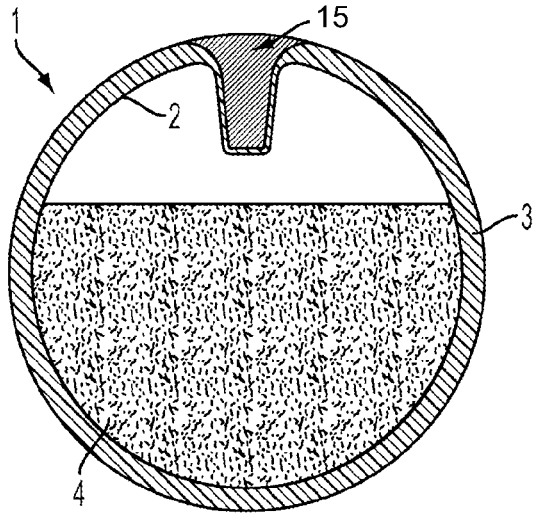
FIG. 10B is a section view showing the same embodiment with the flap closed and after the filler material has been added.

One method of protecting the filler hole is after filling the ball with the filler and adjusting the air pressure within the ball, the filler hole stem can be sealed with a sealant 15 to protect the stem from the outside. This hole plug sealant 15 is a solvent based PVC, non-phthalate material. This sealant is poured into and over the filler hole and the hole plug, filling all vacant air space and sealing the plug securely and firmly into place Alternatively, a self-sealing, filler hole 13, as shown in FIGS. 10A and 10B, can be used. In this self-sealing system, the ball is filled with the weighted filler material 4 through a filler hole. The filler hole 13 has a hole flap 16 at the tip of the filler hole. This flap 16 is forced back and out of the way during the filling process and then after filling is complete the flap flaps back into place, thus closing the filler hole and preventing the filler material 4 from escaping. Then, after filling, the filler hole stem can be externally sealed using the sealing material and the method described above.

The ball described has a variety of unique features not found in presently available practice balls. FIGS. 5 through 8 shows the unique aspect of the ball of the present invention in its ability to absorb energy and to deform so as to not harm bats during practice. The ball can be pitched similar to a standard ball, it can be drop pitched or it can be placed on a T-stand. If a T-stand is used the ball is simply placed on top of the T-stand and hit from there. If the ball is pitched hitter swings at the ball as if she were hitting a standard ball. However, in either situation and upon contact it can be seen that the ball acts entirely different from a standard ball.

Upon contact the ball 1 flexes and conforms to the bat 10, as can be seen in FIGS. 5 through 8. As described above, this provides several advantages over other balls. First, it does not harm the bat during batting practice. Other weighted balls are hard and tend to harm, damage and even destroy bats during practice. The ball of the present invention does not cause injury to the bat.

Next, the ball absorbs a large majority of the energy transferred from the hitter to the ball. Because of this absorption the ball does not travel as far. Also, because of the energy absorption the hitter must strike the ball harder in order to get the ball to carry at all.

As the hitter practices with the ball she trains her muscles to react to the heavier weight and thus learns from the heavier weight how to hit the ball with more strength. As the hitter practices with the ball she builds muscles and muscle memory and thus when hitting a lighter ball she is able to drive through the ball more easily as she has been practicing with a much heavier ball.

Figure 5A:
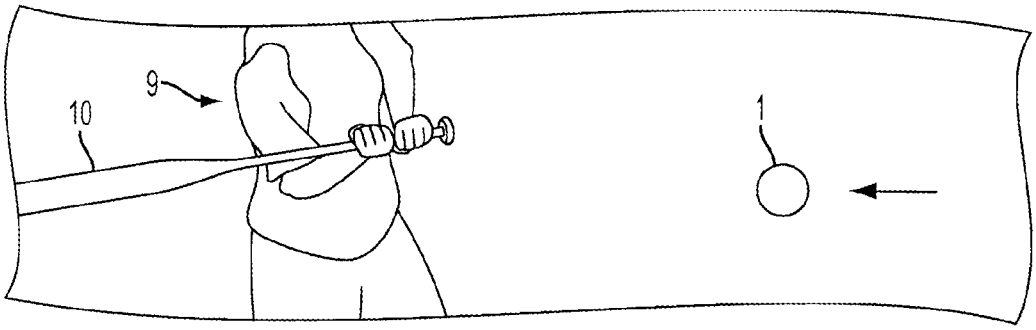
FIGS. 5*a* through 5*c* are a series of figures showing how the ball reacts when hit properly.
Figure 5B:
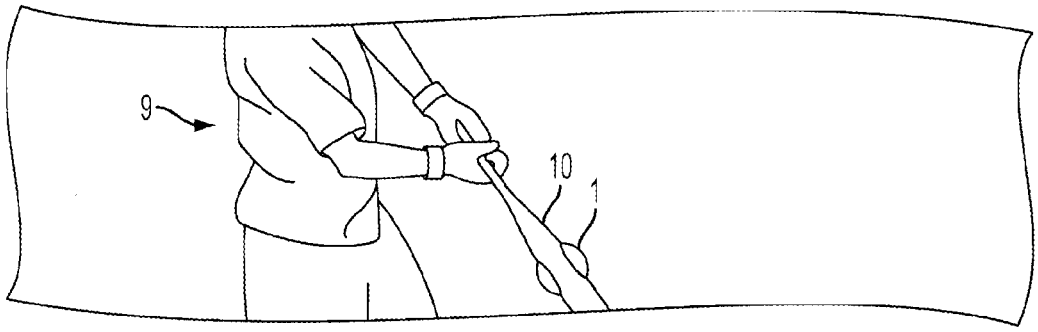
Figure 5C:
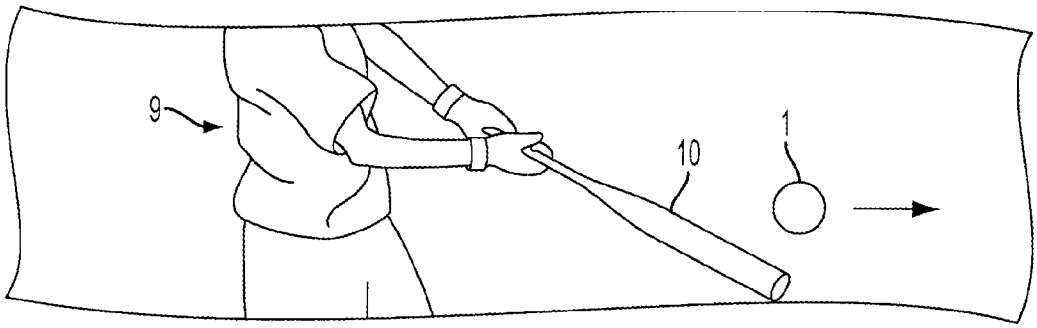

Next, the flexible outer shell 3 and unique filler provides for a flexible ball. As noted, this flexibility protects bats from damage, the weight builds muscle memory, and the flexibility causes the ball to deform differently when it is hit properly and improperly. This resultant deformation provides significant training advantages. FIGS. 5*a* through 5*c* shows a hitter striking a ball properly. As can be seen in the figures the ball forms to the bat, is released from the bat and then projects forward in a relatively straight path. However, if the hitter hits the ball improperly it causes the ball to donut. Donuting occurs when the ball is struck improperly because the improper strike causes the ball to spin irregularly thus causing the granular filler to be forced to the outside of the inside of the shell. This internal force on the shell causes the shell to deform and donut.

Figure 6A:
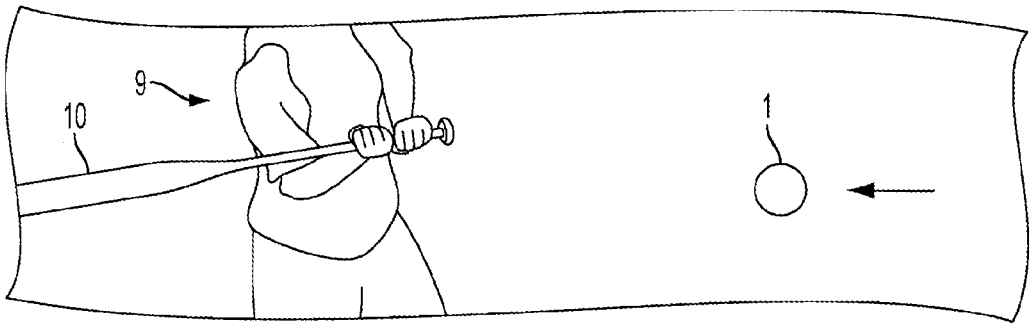
FIGS. 6*a* through 6*c* are a series of figures showing how the ball reacts when hit badly from above.
Figure 6B:
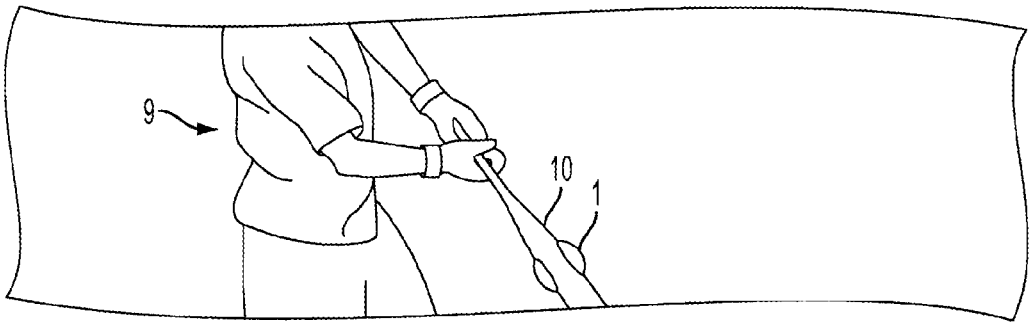
Figure 6C:
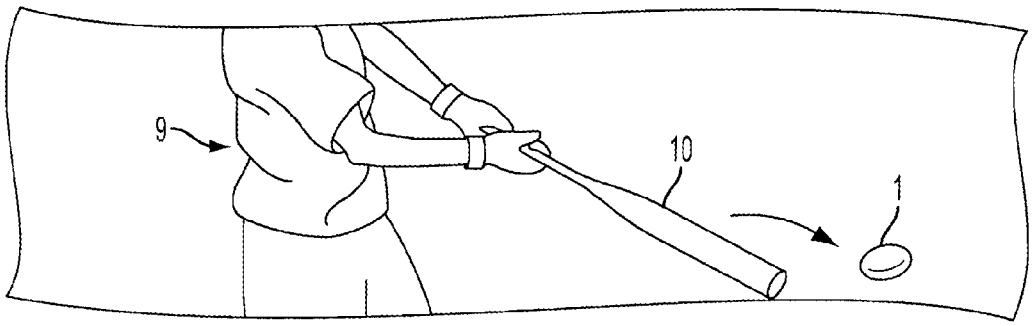
Figure 7A:
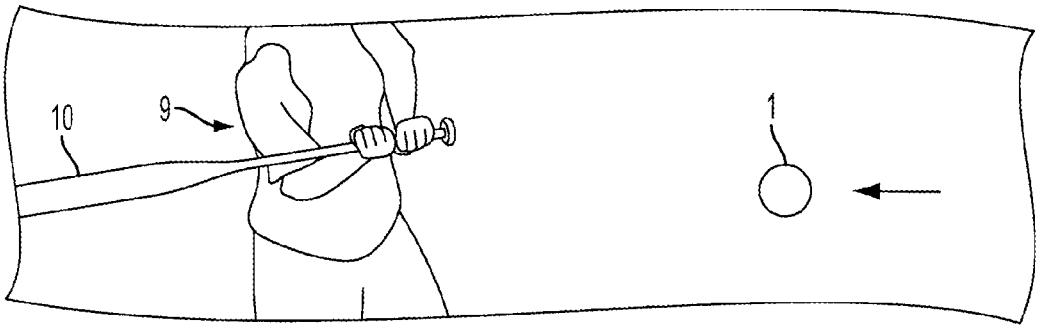
FIGS. 7*a* through 7*c* are a series of figures showing how the ball reacts when hit badly from below.
Figure 7B:
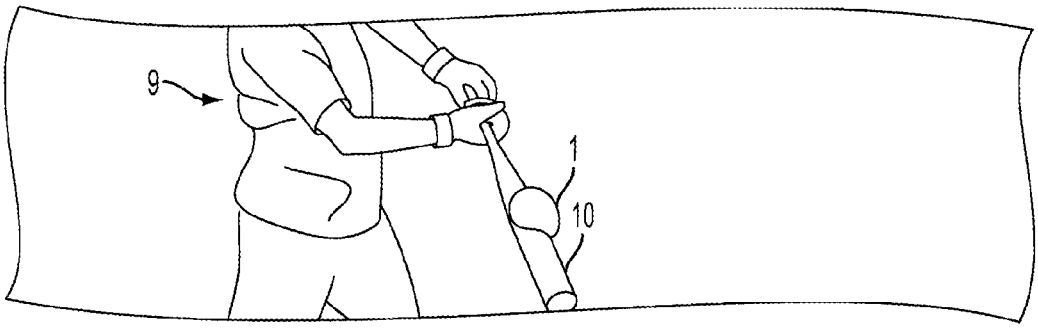
Figure 7C:
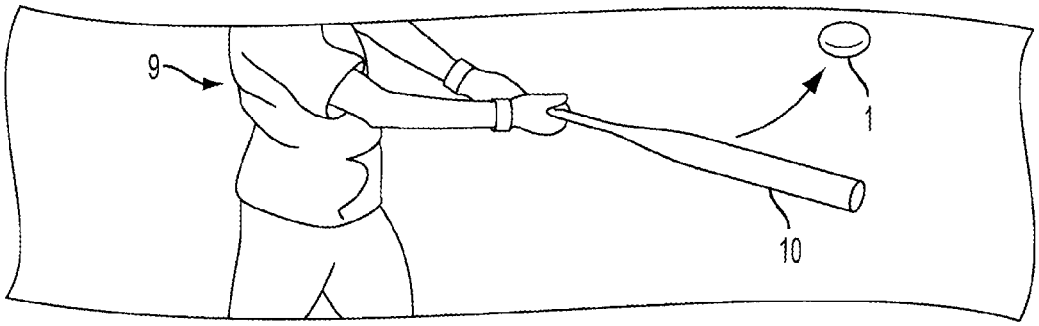
Figure 8A:
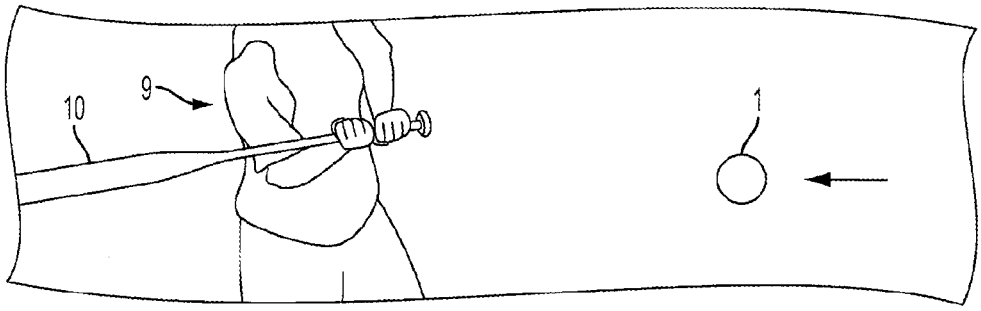
FIGS. 8*a* through 8*c* are a series of figures showing how the ball reacts when hit badly from the inside out.
Figure 8B:
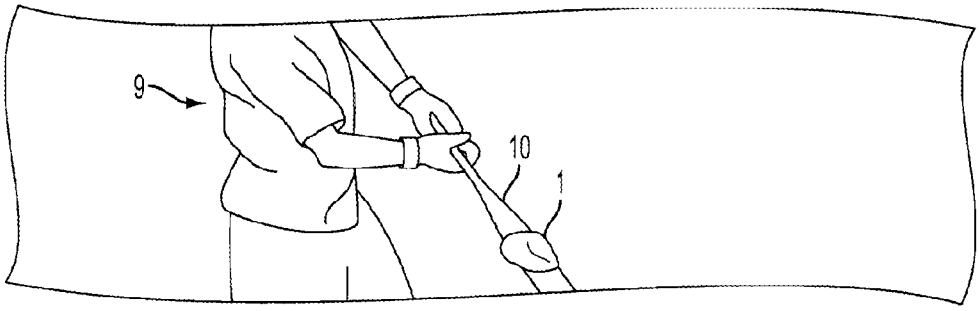
Figure 8C:
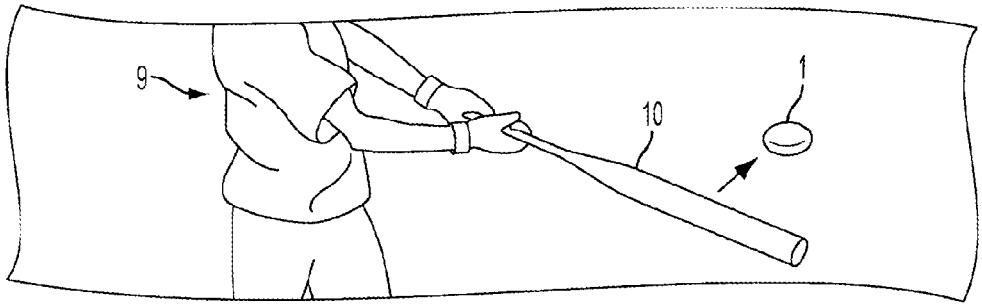
Figure 9A:
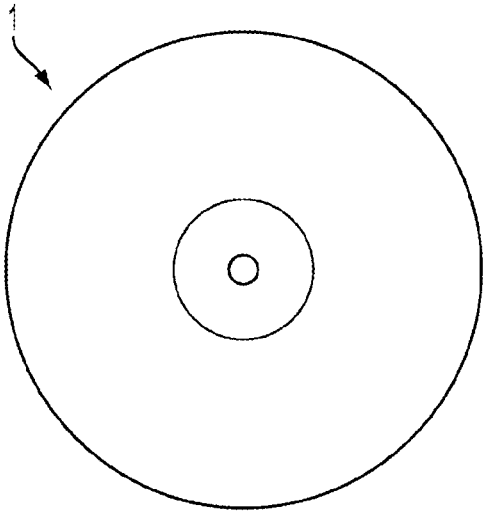
FIG. 9A is a sectional, elevated view showing a standard valve embodiment.
Figure 9B:
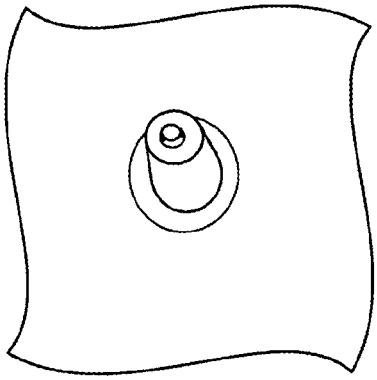
FIG. 9B is an elevated view showing the standard valve from the inside of the ball.
Figure 9C:
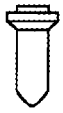
FIG. 9C is a view of a standard plug.
Figure 9D:
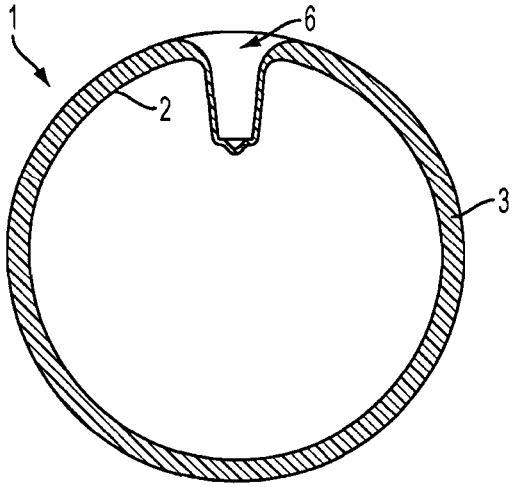
FIG. 9D is a sectional view of the ball prior to plug insertion.
Figure 9E:
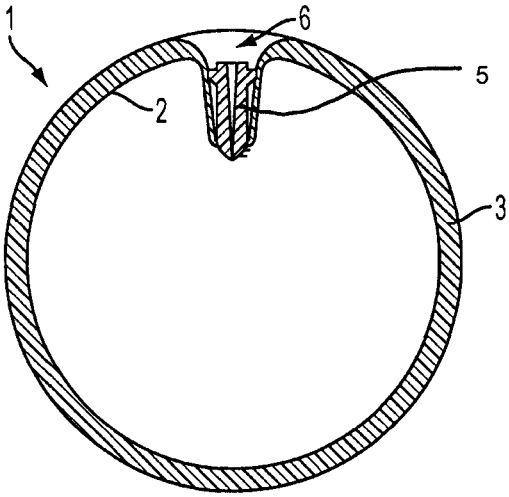
FIG. 9E is a sectional view of the ball after plug insertion.
Figure 9F:
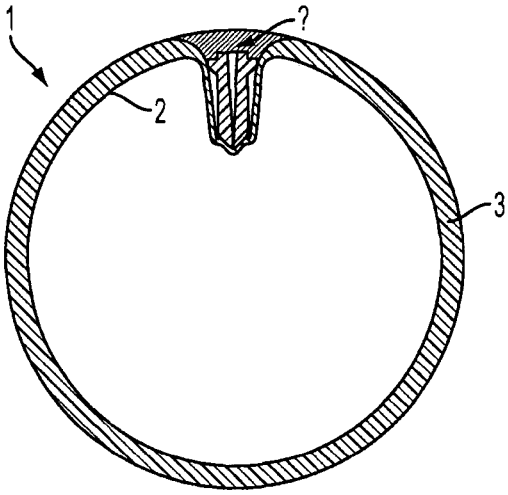
FIG. 9F is a sectional view of the ball after plug insertion and after the sealant is added.

FIGS. 6*a* through 6*c* shows a ball donuting due to a hitter hitting the ball high. FIGS. 7*a* through 7*c* show a ball donuting after a hitter hits the ball low. FIGS. 8*a* through 8*c* shows a ball donuting after a hitter strikes the ball inside out. As can be seen from the figures, if the ball is struck improperly it is immediately apparent to the hitter or trainer as the ball displays the donuting properties. Thus, the ball is an exceptional training tool due to this visual output.

Finally, the thicker outer shell, the outer shell material and the valve reinforcement technology used in the present ball allows for repeated striking and hitting the ball without the ball bursting apart. This provides a ball that may be used for batting practice over an extended period of time. Because the hitter can repeatedly hit the ball the hitter does not need to continually purchase new balls, thus making it more cost effective.

The above description can be used with a softball, baseball, cricket, stickball, over-the-line ball, t-ball, golf or any other ball that may be struck with a bat or club. Further, it is readily apparent that the features described above have the advantage of wide commercial utility. It should be understood that the specific features described are intended to be representative only, as certain modifications within the scope of these teachings will be apparent to those skilled in the art. For example, alternative fillers could be used and/or the dimensions could be varied.

I claim:

1. A weighted ball for hitting comprising:

a resilient, flexible, nonburstable outer shell;

a hollow inner chamber;

a filler hole;

a weighted filler material inserted into said hollow inner chamber through said filler hole;

air inside said hollow inner chamber that displaces the remaining space inside said hollow inner chamber such that an inside air pressure equals an outside air pressure;

a hole plug to seal said filler hole after filling said hollow inner chamber with said weighted filler material;

a hole plug sealant to fill vacant hole plug space, to reinforce and strengthen said hole plug, and to permanently fill and seal said filler hole and said hole plug to prevent escape of said filler material and said air from said ball; and whereby said hole plug sealant forms a portion of said outer cover of said ball.

2. The weighted ball of claim 1 where the durable outer shell is a PVC/non-phthalate material.

3. The weighted ball of claim 2 where the outer PVC/non-phthalate material is at least 2 millimeters thick.

4. The weighted ball of claim 3 where said weighted filler material contains at least 30% course filler material and at least 50% ferrous material.

5. The weighted ball of claim 4 where said course filler material is river sand.

6. The weighted ball of claim 1 where said weighted filler material is a synthetic material.

7. The weighed ball of claim 1 where the filler material further includes approximately 1% of an ultra fine powder.

8. The weighed ball of claim 1 where said ball is a softball or a baseball.

9. The weighted ball of claim 1 where said ball is a golf ball.

10. A weighted ball for hitting comprising:

a resilient, flexible, durable outer shell;

a hollow inner chamber;

a filler hole that includes a self-sealing, flexible end flap that is at rest in an initial, closed position;

a weighted filler material is inserted into said hollow inner chamber through said filler hole, pushing back said end flap, and where said end flap returns to said initial closed position after filling, thus sealing said weighted material inside of said ball;

air inside said hollow inner chamber displaces any remaining space inside said hollow inner chamber such that said inside air pressure equals an outside air pressure;

a sealing material inserted into said filler hole to fill any vacant space and to permanently seal and reinforce said filler hole and to prevent the escape of said filler material.

11. The weighted ball of claim 10 where the durable outer shell is a PVC/non-phthalate material.

12. The weighted ball of claim 11 where the durable outer shell is a PVC/non-phthalate material that is at least 2 millimeters thick.

13. The weighted ball of claim 10 where the weighted material contains at least 30% course filler material and at least 50% ferrous material.

14. The weighted ball of claim 13 where said course filler material is river sand.

15. The weighted ball of claim 10 where said weighted filler material is a synthetic material.

16. The weighted ball of claim 10 where the filler material includes approximately 1% of an ultra fine powder.

* * * * *